United States Patent [19]

Lado

[11] 4,067,682

[45] Jan. 10, 1978

[54] OIL BURNER SYSTEM

[75] Inventor: Ernest Andres Lado, Belle Mead, N.J.

[73] Assignee: Nichols Engineering & Research Corporation, Belle Mead, N.J.

[21] Appl. No.: 601,051

[22] Filed: Aug. 1, 1975

[51] Int. Cl.[2] ..... F23D 11/44

[52] U.S. Cl. ..... 431/11; 431/162; 431/163; 431/210; 431/212; 431/217; 431/160

[58] Field of Search ..... 431/11, 161, 162, 163, 431/207, 210, 212, 216, 217; 110/53

[56] References Cited

U.S. PATENT DOCUMENTS

| | | | |
|---|---|---|---|
| 371,784 | 10/1887 | Orvis | 431/163 |
| 1,520,624 | 12/1924 | Wiederwax | 431/11 |
| 1,564,592 | 12/1925 | Laster | 431/217 |
| 1,874,341 | 8/1932 | Osthoff | 431/11 |
| 2,576,373 | 11/1951 | Wetzel | 110/53 X |
| 3,429,300 | 2/1969 | Eisentrout | 431/160 |

*Primary Examiner*—Edward G. Favors

*Attorney, Agent, or Firm*—Fitzpatrick, Cella, Harper & Scinto

[57] ABSTRACT

Disclosed herein is an oil burner system for burning residual type fuel oils in a high temperature combustion zone or chamber, which includes a method and apparatus for operating the system to maintain the fuel oil at a low viscosity while preventing thermal failure by destruction of the burner which protrudes into the combustion zone or chamber. The fuel oil is preheated and introduced into an oil tube extending through a high temperature furnace wall into the combustion zone or chamber, and also a heated fluid is introduced into the oil tube for passage therethrough with the fuel oil, while the outer periphery of the oil tube is cooled where it passes through the furnace wall and into the high temperature combustion zone or chamber, as well as fabricating the oil tube from a material having a low coefficient of thermal conductivity.

18 Claims, 1 Drawing Figure

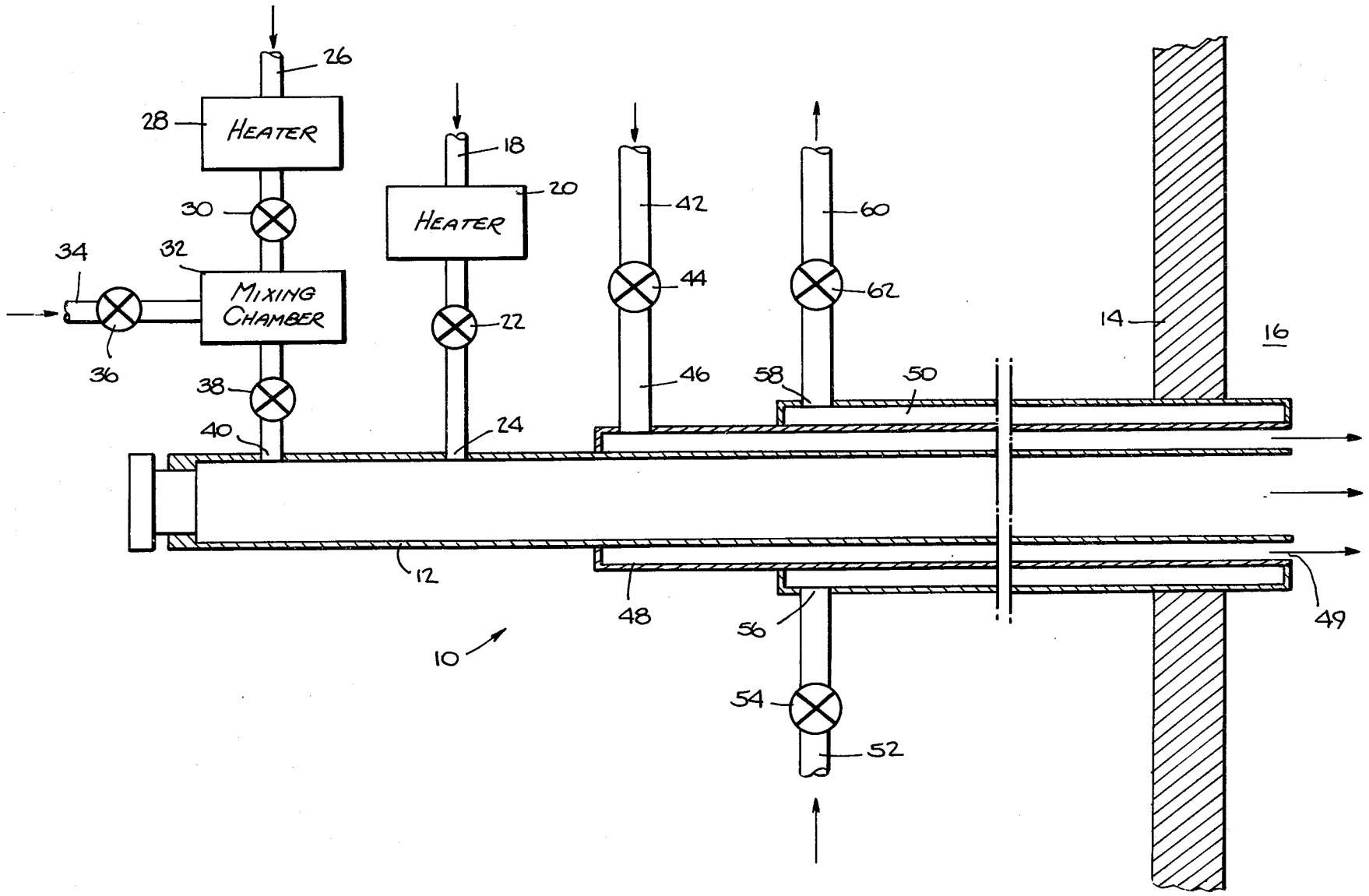
HEATER
HEATER
MIXING CHAMBER
10
12
14
16
18
20
22
24
26
28
30
32
34
36
38
40
42
44
46
48
49
50
52
54
56
58
60
62

OIL BURNER SYSTEM

This invention relates to oil burners and more particularly to methods and apparatus for heating and/or preventing heat losses from oils having high viscosities, such as heavy residual oils, during burner operation.

In the past, burners used for immersed operation in high temperature furnaces and kilns, such as ones operating at from about 3,000° to about 4,000° F., for example, required a cooling system to prevent thermal failure by destruction of the burner, which protrudes into the kiln or furance. When light oils having low viscosity were used, no preheating of the oil was required in order to pump, meter, proportion, and distribute the oil to the various burners. However, when heavy oils, such as the so-called Bunker C (ASTM D396-48T No. 6) were used it was necessary to preheat the oil to temperatures of between about 230° to about 250° F. in order to lower the viscosity to about 100 SSU (Saybolt viscosity, seconds — Universal at 100° F.) for effective handling and burning in the kiln furnace.

When using heavy residual oil, such as Bunker C, the preheated oil was introduced into the burner through an oil tube which was cold because of the cooling effect of an outer water jacket and because of the flow of cold or inadequate adiabatic heating by compression of the secondary air along the outside of the tube. These factors combined to cool the preheated heavy oil, which then could no longer flow freely through the oil tube because of its higher viscosity. In addition to this, the preheated oil was chilled by the usually cold or inadequately heated primary air, again combining to increase the viscosity and preventing free flow of oil.

The present invention involves a novel combination of features combined in such a way as to afford a very efficient and effective solution to the difficulties encountered with the prior art, as will become apparent as the description proceeds.

An object of this invention is to provide a method and apparatus for heating the oil in order to maintain the low viscosity in a burner system, which is designed to keep the burner cool and prevent its destruction under high temperature operation. A further object is to provide means which prevent heat losses from the oil and oil tube to the cooling system mounted on the burner.

A feature of my invention resides in the provision of means for utilizing primary air heated to between about 240° to about 280° F., which preheated air maintains the heavy oil in its preheated conditions until it is discharged from the immersed end of the oil tube into the kiln or other high temperature furnace. According to one aspect of the invention, I provide means for employing steam at a suitable temperature and pressure in place of the primary air to maintain the oil at its required preheated temperature for good flowing characteristics and atomization conditions, and also for flame tempering purposes. One method of flame tempering is illustrated and described in my U.S. Pat. No. 3,734,755 issued May 22, 1973, for example. Another aspect of my invention is to provide means for utilizing a combination of preheated primary air and steam. Still another novel feature of the present invention is the provision of means for minimizing the cooling of the oil by the effect of the cold secondary air flowing on the outside of the oil tube.

In order to accomplish the desired results, this invention provides, in one form thereof, a new and improved oil burner system for burning residual fuel oils in a high temperature combustion chamber characterized by a method of operating the system comprising the steps of preheating the residual fuel oil and introducing it into an oil tube extending through a high temperature furnace wall from the outside to the high temperature combustion zone. Heated fluid is introduced into the oil tube for passage therethrough with the fuel oil. According to one aspect of the invention, the heated fluid is air preheated to a temperature of from about 140° to about 280° F., and according to another aspect of the invention, the preheated fluid is steam, and/or a combination of preheated air and steam. In addition, the outer periphery of the oil tube is cooled where it passes through the high temperature furnace wall and into the high temperature combustion chamber.

Another form of my invention is directed to an oil burner system for burning residual type fuel oils in a high temperature combustion zone characterized by the combination of an oil tube extending through a high temperature furnace wall from the outside to the high temperature combustion zone, the oil tube being fabricated from a material having a low coefficient of thermal conductivity, such as a cermet, for example, a mixture of titanium carbide and metallic nickel. Next, means are provided for preheating the residual fuel oil and introducing it into the oil tube and, in addition, means are provided for introducing a heating fluid into the oil tube for passage therethrough with the fuel oil, and cooling means are provided for cooling the outer periphery of the oil tube where it passes through the high temperature furnace wall and into the high temperature combustion zone.

There has thus been outlined rather broadly the more important features of the invention in order that the detailed description thereof that follows may be understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other methods and structures for carrying out the purposes of the invention. It is important, therefore, that this disclosure be regarded as including such equivalent methods and structures as do not depart from the spirit and scope of the invention.

One embodiment of the invention has been chosen for purposes of illustration and description, and is shown in the accompanying drawing forming a part of the specification, wherein:

The figure is a side elevation schematic of an oil burner assembly for high temperature operation constructed in accordance with the concepts of my invention.

In the embodiment of the invention illustrated, there is provided an oil burner assembly, indicated generally at 10, which comprises an oil tube 12 that passes through a high temperature furnace wall 14 from the outside to the inside combustion zone chamber 16 of a high temperature furnace or kiln, wherein the operating temperature is from about 3,000° to about 4,000° F., for example. The oil tube 12 is supplied with residual heavy oil, such as Bunker C, for example, from a supply line 18 via a heater 20 wherein the oil is preheated to a temperature of the order of about 230° to about 250° F. and thence through a valve 22 for control purposes prior to entering the fuel oil inlet 24 to the oil tube 12.

Primary air is supplied from a supply line 26, and passed through a heater 28 where it is heated to a temperature of between about 240° and about 280° F. The so-heated primary air thence passes through a control duct 30 to a mixing chamber 32. Steam is supplied from a supply line 34 and passed through a valve 36 to the mixing chamber 32. The mixture of steam and heated primary air from the mixing chamber 32 passes through a control valve 38 to an inlet 40 in the oil tube 12. This mixture is utilized for purposes of temperature control in the furnace. In some installations only preheated air is employed, while in other installations only steam is employed. In still other installations, both steam and air are employed. The pressure and temperature of the steam and/or air are so selected as to maintain the heavy residual oil in its preheated condition until it is discharged from the immersed end of the oil tube 12 into the kiln or high temperature furnace 16. Thus, the steam and/or air serves to maintain the oil at its required preheated temperature for good flowing characteristics and atomization condition. In the embodiment employing steam, the steam also serves for flame tempering purposes, as is described in my aforementioned U.S. Pat. No. 3,734,755.

Secondary air is supplied from supply line 42 through a control valve 44 to an inlet 46 in an annular chamber 48 surrounding the oil tube 12. The secondary air is discharged in the combustion zone chamber 16, as at 49. In addition, for purposes of protecting the oil tube 12 from the high temperatures existing in the furnace or kiln, an annular water jacket 50 surrounds the annular chamber 48 and oil tube 12. Cooling water is supplied from a supply line 52 through a control valve 54 to an inlet 56 in the water jactet 50. The water jacket is provided with an outlet 58 through which the cooling water passes to a drain line 60 containing a control valve 62.

It will be appreciated that the oil tube is subjected to a cooling effect due to the outer water jacket 50 and because of the flow of cold or inadequate adiabatic heating by compression of the secondary air in the chamber 48 along the outside of the oil tube. This cooling effect is compensated for by the steam and/or heated primary air, and, in addition, in some installations, in order to further minimize the cooling of the oil by the cold secondary air flowing on the outside of the oil tube 12, the tube is fabricated from a material having a low coefficient of thermal conductivity, such as a cermet made of a ceramic material and a metal. This material combines a mechanical strength approaching that of a metal with the thermal conductivity of a ceramic material. A presently preferred cermet is one fabricated from a mixture of titanium carbide and metallic nickel.

It will thus be seen that the present invention does indeed provide a new and improved oil burner assembly for heavy residual oils without the usual problems of impeded flow and gumming-up when utilizing burners which require cooling systems, and which is superior in operability, reliability and efficiency as compared to prior art such burner assemblies.

Although a certain particular embodiment of the invention is herein disclosed for purposes of explanation, various modifications thereof, after study of this specification, will be apparent to those skilled in the art to which the invention pertains.

What is claimed and desired to be secured by letters patent is:

1. In an oil burner system for reducing the viscosity of Bunker C type fuel oil to a value of the order of about 100 SSU (Saybolt viscosity, seconds-Universal at 100° F.) and burning same in a high temperature combustion zone or chamber, a method of operating said system comprising the steps of preheating residual fuel oil and introducing it into an oil tube extending through a high temperature furnace wall from the outside to said high temperature combustion chamber, introducing a heated fluid into said oil tube for passage therethrough with said fuel oil, enclosing the outer periphery of said oil tube at a point therealong prior to the entry of said tube into said furnace wall to prevent the flow of gaseous fluid between the ambient atmosphere and said furnace, introducing a fluid under pressure into said enclosure and around the periphery of said oil tube thereby cooling the outer periphery of said oil tube where it passes through said high temperature furnace wall and into said high temperature combustion chamber.

2. A method according to claim 1 wherein said heated fluid is primary air and said method further includes the step of preheating the primary air prior to its introduction into said oil tube.

3. A method according to claim 1 wherein said heated fluid is steam.

4. A method according to claim 1 wherein said oil tube is fabricated from a material having a low coefficient of thermal conductivity.

5. In an oil burner system for reducing the viscosity of Bunker C type fuel oil to a value of the order of about 100 SSU (Saybolt viscosity, seconds-Universal at 100° F.) and burning same in a combustion chamber operating at between about 3000° F. and about 4000° F., a method of operating said system comprising the steps of preheating said residual fuel oil and introducing it into an oil tube extending through a high temperature furnace wall from the outside to said high temperature combustion zone or chamber, introducing a heated fluid into said oil tube for passage therethrough with said fuel oil, introducing secondary air into an annular chamber surrounding said oil tube and extending through said high temperature furnace wall from the outside to said high temperature combustion chamber and discharging in said combustion chamber for cooling said oil tube and assisting combustion, and supplying cooling water to a water jacket surrounding said annular chamber and extending through said high temperature furnace wall for preventing thermal failure of said oil tube.

6. A method according to claim 5 wherein said heated fluid is primary air and said method further includes the step of preheating the primary air to a temperature of from between about 240° and about 280° F. prior to its introduction into said oil tube.

7. A method according to claim 5 wherein said fluid is steam.

8. A method according to claim 5 wherein said oil tube is fabricated from a cermet.

9. A method according to claim 8 wherein said oil tube is fabricated from a mixture of titanium carbide and metallic nickel.

10. In an oil burner system for reducing the viscosity of Bunker C type fuel oil to a value of the order of about 100 SSU (Saybolt viscosity, seconds-Universal at 100° F.) and burning same in a high temperature combustion zone or chamber, the combination comprising, an oil tube extending through a high temperature furnace wall from the outside to said high temperature combustion zone or chamber, means for preheating said residual fuel, means for introducing said preheated residual fuel into said oil tube, means for introducing a heated fluid into said oil tube for passage therethrough with said fuel oil, a chamber concentrically disposed about said oil tube, means mounting said chamber about said tube as it passes into said furnace wall, means enclosing the end of said chamber remote from said furnace wall to prevent the flow of gaseous fluid between the ambient atmosphere and said furnace, and means for introducing a pressurized cooling fluid medium into said chamber and around the outer periphery of said oil tube where it passes through said high temperature furnace wall and into said high temperature combustion chamber for cooling said oil tube and assisting combustion of said fuel oil.

11. Apparatus according to claim 10 wherein said heated fluid is primary air and said system further comprises, means for preheating said primary air and means for introducing said so heated primary air into said oil tube for passage therethrough with said fuel oil.

12. Apparatus according to claim 10 wherein said oil tube is fabricated from a material having a low coefficient of thermal conductivity.

13. Apparatus according to claim 12 wherein said oil tube is fabricated from a cermet.

14. Apparatus according to claim 13 wherein said oil tube is fabricated from a mixture of titanium carbide and metallic nickel.

15. Apparatus according to claim 10, wherein said means for cooling the outer periphery of said oil tube includes an annular chamber surrounding said oil tube extending through said high temperature furnace wall from the outside and discharging into said high temperature combustion chamber, means for supplying secondary air to said annular chamber, a water jacket mounted around said annular chamber and extending through said high temperature furnace wall from the outside to said high temperature combustion chamber, and means for supplying cooling water to said water jacket.

16. In an oil burner system for burning residual type fuel oil in a high temperature combustion zone or chamber, a method of operating said system comprising the steps of preheating residual fuel oil and introducing it into an oil tube extending through a high temperature furnace wall from the outside to said high temperature combustion chamber, preheating air and passing such preheated air to a mixing chamber, mixing said preheated air with steam in said mixing chamber, introducing the heated mixture of steam and air into said oil tube for passage therethrough with said fuel oil, and cooling the outer periphery of said oil tube where it passes through said high temperature furnace wall and into said high temperature combustion chamber.

17. In an oil burner system for burning residual type fuel oil in a combustion chamber operating at between about 3000° and about 4000° F., a method of operating said system comprising the steps of preheating said residual fuel oil and introducing it into an oil tube extending through a high temperature furnace wall from the outside to said high temperature combustion zone or chamber, preheating air, mixing said preheated air with steam, introducing the heated mixture of steam and air into said oil tube for passage therethrough with said fuel oil, introducing secondary air into an annular chamber surrounding said oil tube and extending through said high temperature furnace wall from the outside to said high temperatue combustion chamber and discharging in said combustion chamber, and supplying cooling water to a water jacket surrounding said annular chamber and extending through said high temperature furnace wall for preventing thermal failure of said oil tube.

18. In an oil burner system for burning residual type fuel oil in a high temperature combustion zone or chamber, the combination comprising, an oil tube extending through a high temperature furnace wall from the outside to said high temperature combustion zone or chamber, means for preheating primary air means for mixing said preheated air with steam, means for preheating said residual fuel, means for introducing said preheated residual fuel into said oil tube, and means for introducing the heated mixture of steam and air into said oil tube for passage therethrough with said fuel oil, and means for cooling the outer periphery of said oil tube where it passes through said high temperature furnace wall and into said high temperature combustion chamber.

* * * * *